United States Patent [19]

Dellinger et al.

[11] 4,431,068

[45] Feb. 14, 1984

[54] EXTENDED REACH DRILLING METHOD

[75] Inventors: Thomas B. Dellinger, Duncanville; Wilton Gravley, Carrollton, both of Tex.

[73] Assignee: Mobil Oil Corporation, New York, N.Y.

[21] Appl. No.: 144,334

[22] Filed: Apr. 28, 1980

Related U.S. Application Data

[63] Continuation of Ser. No. 12,931, Feb. 16, 1979, abandoned.

[51] Int. Cl.[3] ..... E21B 7/06

[52] U.S. Cl. ..... 175/61; 175/94; 175/73

[58] Field of Search ..... 175/61, 79-83, 175/73-75, 94, 40, 45, 51, 230, 320, 231; 166/67, 117.5, 117.6

[56] References Cited

U.S. PATENT DOCUMENTS

| | | | |
|---|---|---|---|
| 1,804,819 | 5/1931 | Spencer et al. | 175/81 |
| 2,565,794 | 8/1951 | Young | 175/61 |
| 2,608,384 | 8/1952 | Alexander | 175/79 |
| 2,646,253 | 7/1953 | Johnston | 175/61 |
| 2,821,362 | 1/1958 | Hatcher | 166/117.5 |
| 3,105,561 | 10/1963 | Kellner | 175/230 |
| 3,285,349 | 11/1966 | Brandon | 175/61 X |
| 3,599,737 | 8/1971 | Varley | 175/61 |
| 4,063,592 | 12/1977 | Youmanns | 166/67 |
| 4,076,084 | 2/1978 | Tighe | 175/73 |

FOREIGN PATENT DOCUMENTS

| | | | |
|---|---|---|---|
| 2232669 | 1/1975 | France | 175/79 |

OTHER PUBLICATIONS

"Directional Technology will Extend Drilling Reach" *Oil and Gas Jouranal* pp. 153-169, 9-15-1980.

*Primary Examiner*—William F. Pate, III
*Attorney, Agent, or Firm*—A. J. McKillop; M. G. Gilman; J. F. Powers, Jr.

[57] ABSTRACT

This specification discloses a rotary drilling technique for drilling a highy deviated wellbore into the earth's crust wherein a drill string comprised of drill collars and drill pipe is used to advance a drill bit attached to the drill pipe at the lower end of the drill string into the earth and form the wellbore. A first portion of the wellbore is formed to extend into the earth's crust and thereafter a highly deviated second portion of the wellbore is formed by drilling with the drill string arranged to have the drill collars located in the first portion of the wellbore and to apply compressive force on the drill pipe that extends therebelow and thus on the drill bit attached to the lower end thereof to apply the desired weight-on-bit for effective drilling of the second portion of the wellbore.

5 Claims, 1 Drawing Figure

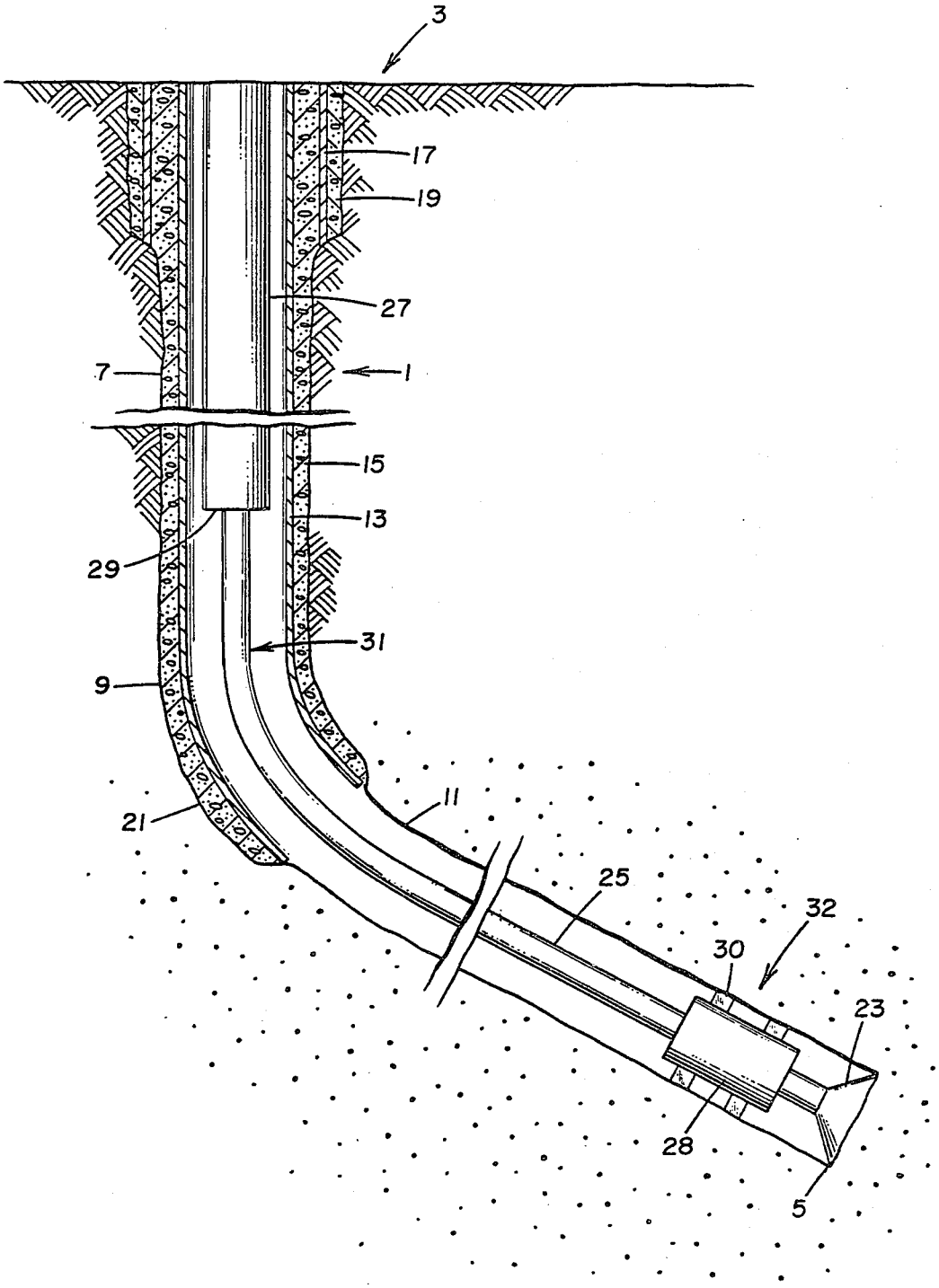
3
17
19
27
7
1
15
13
29
31
9
11
21
25
32
30
23
28
5

EXTENDED REACH DRILLING METHOD

This is a continuation of application Ser. No. 012,931 filed Feb. 16, 1979, now abandoned.

BACKGROUND OF THE INVENTION

This invention is concerned with an extended reach drilling technique for providing a highly deviated wellbore that extends from a surface location, land or marine, essentially vertically into the earth and thereafter extends in a highly deviated attitude into the earth such that the wellbore penetrates a mineral-bearing formation at a subsurface location spaced a great lateral distance from the surface location.

Wellbores and wells have been drilled to extend into the earth in directions other than vertical for various reasons and by various techniques. A need for such wells was early recognized and still exists today for tapping mineral reserves located beneath water bodies or located beneath other poorly accessible surface locations. For example, before the turn of the century the Summerland Field located underwater near Santa Barbara, Calif. was drilled by whipstocking holes out under the water from land locations.

More recent developments have enabled ultrahigh-angle wellbores to be drilled and completed. Techniques for drilling ultrahigh-angle wellbores are sometimes referred to as "extended reach drilling", a term that has been coined to describe rotary drilling procedures used to drill wellbores greater than 60 degrees from the vertical and wherein complex wellbore profiles may be used to extend the horizontal limits of wellbores. Such techniques may be used to provide a wellbore that extends from a surface location to a subsurface location spaced a great lateral distance therefrom.

In an article entitled "Ultrahigh-Angle Wells Are Technical and Economic Success", THE OIL AND GAS JOURNAL, July 19, 1976, pp. 115–120, there is described a project wherein a well was drilled and completed to a 12,300-foot measured depth at an average angle of 82°. In a paper, SPE 6818, "Improved Techniques For Logging High-Angle Wells" by M. W. Bratovitch, W. T. Bell, and K. D. Kaaz, which was presented at the 52nd Annual Fall Technical Conference and Exhibition of the Society of Petroleum Engineers of AIME in Denver, Colo., Oct. 9–12, 1977, it is said that high-angle wells are becoming commonplace, particularly in offshore areas. The paper describes work which contributes to increasing the deviation angles at which wells can be conventionally logged and to deciding whether to try gravity descent or pump-down tools as a first attempt at logging high-angle wells.

In U.S. Pat. No. 4,063,592 to Arthur H. Youmans, there is described a system for logging highly deviated earth boreholes which system is comprised of a conventional logging instrument that is adapted to transverse a slanted or deviated earth borehole on the end of a conventional logging cable.

In U.S. Pat. No. 3,285,350 to J. K. Henderson, there is described a technique for drilling off-vertical holes through earth formations and more particularly a technique and apparatus for controllably drilling holes through and substantially parallel to mineral formations between separated wells.

SUMMARY OF THE INVENTION

This invention is directed to a method of drilling a highly deviated wellbore into the earth's crust by a rotary drilling technique wherein a drill string comprised of drill collars and drill pipe is used to advance a drill bit attached to the drill pipe at the lower end of the drill string into the earth and form the wellbore. A first portion of the wellbore is formed to extend essentially vertically into the earth's crust from a surface location thereof to a kick-off point at the lower end of the first portion. A second portion of the wellbore is initiated at the kick-off point which second portion is deviated to a highly deviated attitude from the vertical. The second portion of the wellbore is formed and extended into the earth with the drill string arranged to provide for the drill collars to be located within the first vertical portion and the drill pipe and bit to be located within the second deviated portion of the wellbore. The second portion of the wellbore is extended until the lower end of the lowermost drill collar in the first vertical portion of the wellbore descends to a location of about the kick-off point. Thereafter the drill string is at least partially pulled from the wellbore and additional drill pipe is added thereto below the drill collars after which drilling is continued to extend the second portion of the wellbore further into the earth's crust.

BRIEF DESCRIPTION OF THE DRAWING

The drawing is a schematic view of a highly deviated wellbore illustrating the method and system of this invention.

DESCRIPTION OF THE PREFERRED EMBODIMENTS

This invention is directed to a rotary drilling technique for drilling a highly deviated wellbore into the earth and is applicable for drilling an extended reach wellbore. Hereafter when reference is made to a highly deviated wellbore it is to be understood that the term includes an extended reach wellbore and other wellbores that are sufficiently deviated that conventional rotary drilling techniques are not satisfactory for supplying sufficient weight on the bit for effective drilling. Extended reach drilling techniques are particularly useful for providing multiple offshore wells from a single drilling platform, though they may also be used in land drilling.

In rotary drilling operations a drill string is employed which is comprised of drill pipe, drill collars, and a drilling bit. The drill pipe serves to transmit rotary torque and drilling mud from a drilling rig to the bit and to form a tensile member to pull the drill string from the wellbore. In normal operation the drill pipe is always in tension during drilling operations. Drill pipe commonly varies from $3\frac{1}{2}''$ to $5''$ in outside diameter. Drill collars are thick-walled pipe as compared to the drill pipe and thus are heavier per linear foot than the drill pipe and may be referred to as "heavy weight pipe". The drill collars act as stiff members in the drill string. The drill collars are normally installed in the drill string immediately about the bit and serve to supply weight to the bit. In common rotary drilling techniques, only about the bottom three-fourths of the drill collars are in axial compression to load the bit during drilling while about the top one-fourth of the drill collars is in tension as is the drill pipe. The drill collars used in conducting rotary drilling techniques are of larger diameter than the drill pipe in use and normally are within the range of 4½" to 10" outside diameter.

In carrying out rotary drilling techniques, a drilling rig is employed which utilizes a rotary table for applying torque to the top of the drill string to rotate the drill string and the bit. The rotary drill table also acts as a base stand on which all tubulars, such as drill pipe, drill collars and casing, are suspended in the hole from the rig floor. A kelly is used as a top tubular member in the drill string and the kelly passes through the rotary table and is acted upon by the rotary table to apply the torque through the drill string to the bit. Fluid or mud pumps are used for circulating drilling fluid or mud intermediate the drilling rig and the bottom of the wellbore. Normally, the drilling fluid is pumped down the drill string and out through the drill bit and returns to the surface through the annulus formed outside of the drill string. The drilling fluid serves such purposes as cooling the bit, removing earth cuttings made by the drilling bit from the wellbore, and lubricating the drill string to lessen the energy required in rotating the drill pipe. In completing the well, casing is normally run thereinto and is cemented to maintain the casing in place.

Rotary drilling equipment is utilized in carrying out extended reach drilling but many problems are encountered in providing the complex profiles and the greater-than-sixty-degree wellbores that are formed in carrying out extended reach drilling which are not encountered in carrying out conventional rotary drilling techniques. One such problem involves applying weight on the drilling bit as required to form the wellbore. As discussed above, in conventional rotary drilling techniques drill collars are used in the drill string immediately above the drill bit to supply this weight. In conducting extend reach drilling in the highly deviated portion of a wellbore, the use of drill collars immediately above the drill bit results in the weight of the drill collars being applied primarily to the lower side of the highly deviated wellbore rather than to the bit. The effect of the weight of the drill collars on the weight applied to the bit becomes progressively less as the angle from vertical of the highly deviated portion of the wellbore is increased and the wellbore is extended into the earth until the weight of the drill collars is applied essentially only to the lower side of the extended portion of the wellbore. Thereafter the drill collars become a detriment with regard to applying weight on the bit inasmuch as they must be forced along the highly deviated portion of the wellbore to apply weight on the bit.

In accordance with this invention, there is provided a method of drilling a highly deviated wellbore into the earth's crust by employing rotary drilling equipment including a drill string that is comprised of drill collars, drill pipe, and a drill bit, and wherein there is formed a first portion of the wellbore that extends essentially vertically into the earth's crust from a surface location thereof to a kick-off point at the lower end of the first portion. A second portion of the wellbore is initiated at the kick-off point and is deviated to follow a track or direction that is highly deviated with the vertical. Thereafter the drill string is pulled from the wellbore and arranged to provide for the drill bit at the lower end thereof and drill pipe connecting therewith to be of a length greater than that length of the wellbore from the kick-off point to the bottom thereof. Drill collars are next attached to the drill pipe in a desired length to apply compressive force through the drill pipe to the drill bit and to be maintained in the first vertical portion of the wellbore. The drill string is run into the wellbore and drilling is commenced by rotating the drill string and circulating drilling fluid intermediate the drilling rig and the bottom of the wellbore. As drilling proceeds and the length of the borehole is increased, additional drill collars are added to the drill collar section as desired to supply weight on the drill bit. After a sufficient length of drill collars is inserted into the first vertical portion of the wellbore to supply sufficient weight on the bit, drill pipe may again be added to the drill string above the drill collars to connect with the kelly which extends through the rotary table. The drilling operations are carried out until the lower end of the column of drill collars reaches about the kick-off point at the lower portion of the vertical section of the borehole. Thereafter the drill string is pulled until at least all of the drill collars are removed from the wellbore. Quite often the entire drill string will be pulled from the wellbore such that the drill bit may be inspected or replaced as desired. The drill bit is then again reassembled to drill pipe of sufficient length to provide a length thereof equivalent to at least the length of the highly deviated portion of the wellbore from the kick-off point to the bottom thereof plus an additional length equivalent to the length which the wellbore will be extended during the next cycle of operation. Thereafter, drill collars are added to the drill string and the drill string is rerun in the wellbore until the drill bit reaches the bottom thereof and drilling is resumed and continued until the lower portion of the column of the drill collars again reaches about the kick-off point after which the drill string is again pulled from the wellbore such that additional drill pipe may be added above the drill bit for another cycle of drilling.

There also may be employed along the drill pipe in the vicinity of the drill bit a means for appyling force along the drill pipe to the drill bit. A hydraulic drill collar is such a means which is suitable for applying additional weight on a bit.

This invention is hereafter described in more detail by reference to the drawing. There shown is a highly deviated wellbore 1 which extends from the surface 3 of the earth to the lower portion 5 of the wellbore. The highly deviated wellbore is comprised of a first portion 7, illustrated in the drawing as being vertical but which may be a low-angle portion that makes an angle with the vertical of no more than about 40°, that extends from the surface of the earth 3 to a kick-off point 9 at which point the deviation of the wellbore is initiated and a highly deviated second portion 11 which extends from the kick-off point 9 therefrom to the wellbore bottom 5. A casing string 13 is normally installed in the first vertical portion of the wellbore to extend sufficiently beyond the kick-off point 9 to facilitate the initiation of the highly deviated second portion of the wellbore. This casing string 13 will normally be held in place by a cement sheath 15. The wellbore 1 may be also provided with a shallow or surface string of casing 17 which is held in place by cement sheath 19.

In providing the highly deviated wellbore 1 there is formed a first portion of the wellbore which extends from the surface 3 of the earth, be this from a land surface or from the bottom of a marine body, to about the kick-off point 9. This first portion of the wellbore may be provided by drilling, using conventional rotary drilling techniques. The second portion 11 of the wellbore is then initiated at about the kick-off point 9 and the initial deviated portion of the wellbore is shown at 21. At this stage of the drilling operation, it is highly desirable as discussed above to set a string of casing 13 in the first portion of the wellbore which extends beyond the kick-off point along the portion 21 of the wellbore.

Thereafter the drill string is arranged for drilling the second portion 11 of the wellbore. This arrangement is comprised of the drill bit 23 being attached to drill pipe 25 which is in turn attached to the drill collars 27. As illustrated in the drawing, the second portion 11 of the wellbore has been extended beyond the kick-off point 9 around the portion 21 where the deviation of the wellbore is primarily initiated and to the well bottom 5. A sufficient length of the drill pipe 25 is provided to extend from the drill bit 23 along the entire length of the second portion 11 of the wellbore and up into the first portion 7 of the wellbore to the bottom 29 of the drill collar column 27. The drill collar column 27 is of sufficient length to provide a desired weight-on-bit for effective drilling, but a length which allows it to be maintained in the first portion of the wellbore. In this illustration, the second portion 11 of the wellbore may be extended for the distance from the bottom 29 of the drill collars 27 to about the kick-off point 9. If extended significantly beyond the kick-off point 9, the drill collars 27 will begin contacting the deviated portion 21 of the wellbore 11 and lie along the lower side of the second portion 11, thus lessening the weight applied to the bit. Thus, at about the time that the bottom 29 of the drill collars 27 reaches the kick-off point, the drill string 31 is pulled from the wellbore or at least all of the drill collars 27 are pulled therefrom. Normally, the drill pipe 25 will also be pulled from the wellbore such that the drill bit 23 may be inspected and replaced as desired. Thereafter the drill string 31 is again run into the wellbore 1 and arranged such that the drill bit 23 is connected to a sufficient length of drill pipe 25 to extend from the bottom 5 of the wellbore up into the first section 7 thereof for a distance equivalent to that which the second portion 11 will be extended into the earth's crust during the next cycle of the drilling operation.

As mentioned above, a suitable tool for applying pressure on the rock bit in conjunction with the compressive pressure applied by the drill pipe is a downhole tool known as a hydraulic drill collar. The hydraulic drill collar is also referred to as a hydraulic wall-anchored drill collar and a hydraulic-actuated drill collar. The hydraulic drill collar has two major sections, a push-down section 28 and an anchor section 30 plus a retaining latch. The push-down section 28 has one or more single acting hydraulic cylinders staged in series and the bit load or weight or weight-on-bit that is applied on the bit is a result of a differential pressure that is applied on the pistons within the cylinders. For a more complete description of the hydraulic drill collar, reference is made to an article entitled "Hydraulic Wall-Anchored Drill Collar Promises Lower Drilling Costs" by J. M. Kellner and A. P. Roberts, published in THE OIL AND GAS JOURNAL, Oct. 3, 1960, vol. 48, No. 40; pp. 87–89 and to U.S. Pat. No. 3,105,561, "Hydraulic Actuated Drill Collar" to J. M. Kellner.

For a still better understanding of this invention a more detailed description thereof is given describing a method of drilling a highly deviated or extended reach wellbore of a designed profile wherein the first portion of the wellbore is designed to be about 2000 feet in length and wherein the second highly deviated portion of the wellbore is designed to be about 10,000 feet in length. In the carrying out of this method to provide this designed highly deviated wellbore, the first vertical portion of the wellbore is provided by conventional rotary drilling methods. At the kick-off point 9, the hole is deviated from the vertical by any of several deflection means, such as jet deflection or a downhole mud motor and bent sub. As an example, 1000 feet of drill collar in a 2000-foot section of vertical hole will permit the hole to be extended 1000 feet before the bottom 29 of the drill collar reaches the kick-off point 9. At this point the drill string is removed from the hole to at least the bottom of the drill collars, a 1000-foot length of drill pipe placed in the string and then the drill collars are again placed at the top of the drill pipe. Another advancement of 1000 feet is now possible with the drill collars remaining in the vertical portion of the hole.

What is claimed is:

1. A method of drilling a highly deviated wellbore into the earth's crust by a rotary drilling technique wherein a drill string comprised of drill collars and drill pipe is used to advance a drill bit attached to the drill pipe at the lower end of said drill string into the earth and form said wellbore, comprising:

(a) forming a first portion of said wellbore to extend into said earth's crust from a surface location thereof to a kick-off point at about the lower end of said first portion; said first portion of said wellbore being at an angle with the vertical of not greater than about 40 degrees; said first portion of said wellbore being of sufficient depth to accommodate a sufficient length of drill collars to provide a desired weight-on-bit for effective drilling;

(b) initiating a second portion of said wellbore at said kick-off point and deviating said second portion to a highly deviated angle from the vertical of greater than 60 degrees;

(c) extending said second portion of said wellbore into the earth's crust with said drill string arranged to provide for said drill collars to be located essentially within said first portion of said wellbore, said drill collars being connected at the lower portion thereof with said drill pipe and said drill bit being connected to the lower portion of said drill pipe to be located within said second deviated portion of said wellbore to provide compressive force on said drill bit;

(d) continuing step (c) until the lowermost drill collars in said first portion of said wellbore descend to a location at about said kick-off point;

(e) pulling said drill collars from said wellbore;

(f) adding additional drill pipe into said drill string below said drill collars; to insure that said drill collars will be located essentially within said first portion of the wellbore and (g) rerunning said drill pipe into said wellbore and repeating steps (c) and (d).

2. The method of claim 1 wherein said drill string further includes a hydraulic drill collar positioned along said drill pipe above and in the vicinity of said drill bit.

3. The method of claim 1 wherein said first portion of said wellbore extends essentially vertically into said earth's crust.

4. The method of claim 1, wherein said drill collars are thick walled pipe as compared to said drill pipe and are heavier per linear foot than said drill pipe.

5. The method of claim 4, wherein said drill collars have an outside diameter of within the range of 4.5 inches to 10 inches, and said drill pipe has an outside diameter of from 3.5 inches to 5 inches.

* * * * *